United States Patent [19]

Ashton et al.

[11] Patent Number: 4,612,968

[45] Date of Patent: Sep. 23, 1986

[54] METHOD OF CASTING USING EXPENDABLE PATTERNS

[75] Inventors: Michael C. Ashton, Sheffield; Derek A. Bish, Dronfield; Stephen G. Sharman, Greenhill, all of England

[73] Assignee: Steel Castings Research and Trade Association, Sheffield, England

[21] Appl. No.: 763,759

[22] Filed: Aug. 7, 1985

Related U.S. Application Data

[63] Continuation of Ser. No. 686,622, Dec. 28, 1984, abandoned, which is a continuation of Ser. No. 322,508, Nov. 18, 1981, abandoned.

[30] Foreign Application Priority Data

Nov. 21, 1980 [GB] United Kingdom ..... 8037503

[51] Int. Cl.[4] ..... B22C 9/04; B22C 15/10; B22C 15/22

[52] U.S. Cl. ..... 164/34; 164/7.1; 164/65; 164/39

[58] Field of Search ..... 164/34–36, 164/7.1, 65, 39

[56] References Cited

U.S. PATENT DOCUMENTS

| | | | |
|---|---|---|---|
| 3,446,265 | 5/1969 | Buck | 164/39 X |
| 3,557,867 | 1/1971 | Krzyzanowski | 164/34 X |
| 3,678,989 | 7/1972 | Krzyzanowski | 164/34 X |
| 3,842,899 | 10/1974 | Hauser-Lienhard | 164/253 |
| 3,944,193 | 3/1976 | Imai et al. | 164/39 X |
| 4,222,429 | 9/1980 | Kemp | 164/34 |

*Primary Examiner*—Kuang Y. Lin

*Attorney, Agent, or Firm*—Caesar, Rivise, Bernstein & Cohen

[57] ABSTRACT

A method of casting a metal article in a mould box comprises locating an expendable pattern in the box, the pattern having a gas permeable refractory coating thereon, placing and compacting unbonded particulate material about the pattern and supplying molten metal into the box so as to vaporize or burn away the pattern and form the article of defined shaped while applying a vacuum during casting. According to this invention, the method is improved by compacting the particulate material to a maximum bulk density where it contacts the coated pattern and applying a vacuum to the compacted particulate material so as to create sufficient pressure gradient in the height of the compacted material to maintain the integrity of the gas permeable refractory coating. In this way, the risk of mould collapse, metal breakout, and pollution are reduced.

5 Claims, 1 Drawing Figure

METHOD OF CASTING USING EXPENDABLE PATTERNS

This application is a continuation of application Ser. No. 06/686,622, filed Dec. 28, 1984, now abandoned, which is a continuation of application Ser. No. 322,508, filed Nov. 18, 1981, now abandoned.

The present invention relates to the casting of shapes of molten metal by a technique involving the use of a so-called expendable pattern. In this technique pattern made of a heat destructible material is surrounded by a mould material in a mould box; molten metal is brought into contact with the pattern which is vaporised or burnt out to form a cavity which is filled with molten metal which, upon solidification, forms a cast shape.

The use of an expendable pattern was probably first proposed by Shroyer, see British Pat. Nos. 850331 (1960). Many proposals have been made to improve the technique: see e.g. British Pat. Nos. 945208; 955021; 999316; 1039086 and 1076198. A significant advance was made in the technique with the use of an unbonded sand as the mould material, see British Pat. No. 1127327 (1968). In the improved technique, the expendable pattern is placed within a binder-free flowable sand in a mould box and the sand is then subjected to vibration, preferably (sic) at the mould material ultrasonic frequencies.

There have been many variations on the technique. In one set of proposals, a vacuum is applied to the sand, with or without vibration. It is known to fluidise the sand in order to insert the expendable pattern, then to collapse the fluidised bed and apply a vacuum to aid compaction. Such proposals are exemplified by British Pat. No. 1254592 (1971), 1572860 (1980) and U.S. Pat. No. 3842899 (1974). It has also been proposed to seal the body of sand by placing a plastic sheet on the top of the box and applying a vacuum to establish a uniform vacuum level in the body, see for example British Pat. Nos. 1401239 (1975) and 1403240 (1975).

It has also been appreciated that the pattern itself can be treated with a gas-permeable refractory paint or coating, see British Pat. Nos. 945208 (1963), 999316 (1965), 1039086 (1966).

There is disclosed in U.S. Pat. No. 4222429 (September 1980), a method of casting in which a bed of sand is fluidised, a coated pattern is forced into the sand, the sand is defluidised, and the bed may be subjected to vibration and a vacuum may be drawn, optionally placing a top cover on the bed to establish a uniform vacuum. Metal is then cast and allowed to cool following which the sand is refluidised and the casting is heat treated.

Despite the range of proposals available, the use of an expendable pattern in unbonded particulate material has problems and risks. None of the proposals is wholly reliable. Three areas still cause anxiety: the risk of pollution caused by burnout of the expendable pattern, the risk of explosion caused by inadequate removal of the products of vaporisation of the pattern, and collapse of the mould which happens unpredictably.

The invention is based upon the discovery that many of the drawbacks of the prior proposals may be overcome by creating a controlled pressure gradient in the height of the particulate material in the box. For this invention, the top of the box must be open to the atmosphere and the particulate material must be compacted i.e. the bulk density thereof must exceed a minimum value.

According to one aspect of this invention there is provided a method of casting a metal article in a mould box having a top open to the atmosphere: comprising locating an expendable pattern in the box, the pattern having a gas permeable refractory coating thereon; placing and compacting unbonded particulate material about the pattern; and supplying molten metal into the box so as to vaporise or burn away the pattern and form the article of defined shape while applying a vacuum during casting characterised by:

(i) compacting the particulate material to maximise the bulk density of the material in contact with the coated pattern; and (ii) applying a vacuum to the compacted particulate material so as to create sufficient pressure gradient in the height of the compacted material to maintain the integrity of the profile of the gas permeable refractory coating.

The gas permeable refractory coating may be selected from the many available in the literature and having regard to the metal being cast. The permeability of the coating causes a pressure drop through the coating layer under the vacuum applied during casting thus holding the coating layer in intimate contact with the compacted particulate material when the expendable pattern has vaporised. The degree of permeability required of a coating when used in the invention is that the coating must be sufficiently impermeable to create a pressure drop across the coating layer to provide adequate support for the compacted particulate material and to prevent metal penetration, yet permeable enough to allow the gases arising from the vaporisation of the pattern to escape through the coating. The refractoriness required will depend on the metal being cast and suitable refractory materials are well known and available. The coating may be applied by a variety of methods; brush, spray, dipping, overpouring, etc. More than one layer may be applied sequentially. Most preferably the coating has a low binder content so that it does not dry to form a hard crackable coating. As is known, the refractory materials will be selected according to the metal being cast.

Preferably the patterns are made in expanded polystyrene or like polymers having a density of about 20 kg/cu.m. Low density patterns are prone to flexing during moulding and damage during handling, whereas high density patterns produce excessive gas.

In a modification of the method, the coated expendable pattern is removed by heat before casting, leaving the gas permeable refractory shell within the compacted particulate material. In such case, the pattern may be coated with a ceramic slurry which is chemically cured or allowed to dry to form a shell. The pattern may be vaporised or burned out before or after investing the shell in the particulate material. The method is seen to good advantage especially when used with relatively thin shells since such shells are well supported.

A feature of the invention is the deliberate compaction of the particulate material to a predetermined degree. The purpose of compaction in this invention is twofold, firstly to cause the particulate moulding material to flow into intimate contact with the surface of the coated pattern irrespective of its contours so eliminating the need for cores and secondly to compact the mass of the material by bringing the individual particles in close contact, ideally until they can be brought no closer together. One way of determining the degree of compaction is by measuring the bulk density of the material used and subjecting that material to compaction so as to maximise the bulk density where it contacts the coated pattern. A preferred method of compaction to achieve the maximum is vibration since this is efficient and can be used where the mass of particulate material is large; high frequency low amplitude vibration is preferred and the force rating of the vibrator is preferably of the order of 0.75 of the total load it is vibrating, giving the moulding box an acceleration of about 1.5 g. A frequency of at least 40 Hertz is preferred to cause the material to flow about complexly shaped patterns. Vibration can be performed by a vibrator attached to the side of the moulding box, but preferably the box is mounted on a vibrating table since vibration is more uniform. Both electric and air vibrators are suitable. Maximum consolidation appears to be achieved in a short time, between 30 and 60 seconds, depending upon pattern complexity, and this may be detected visually by the fall in level of the material in the box and then the presence of a shimmer or rolling of the top surface of the sand, which shimmer or rolling is constant. It must be stressed that the purpose of compaction is to bring the particles together, not to evacuate the air between the particles, and for this reason the application of a vacuum does not produce compaction for the purpose of this invention. Alternative methods of compaction include centrifuging, mass dropping, jolting and the like.

The coated pattern is placed in the unbonded particulate material below the top surface thereof and the height of unbonded particulate material above the expendable pattern is of importance in the method. If the height is less than about 20 cm, for example in the case of ferrous metals, the metallostatic pressure arising during casting may cause deformation or lifting or even collapse of the mould. The minimum height ensures that a minimum pressure reduction is applied to the granular material at the top of the pattern. In some earlier proposals weights are placed on the top surface of the material to counteract the lifting tendency; such weights are not required in the method of this invention. The maximum height is determined by the size of the mould box.

The level of vacuum needed will be related inter alia to the degree of compaction of the particulate material, the metal being cast and the properties of the gas permeable refractory coating present on the expendable pattern. Insufficient vacuum will not create enough pressure gradient and there will be a risk that the mould will collapse; too great a vacuum may cause the pattern to deform and the gas permeable refractory coating to crack; it may also cause penetration of metal into the refractory coating giving poor surface finish of the casting. The vacuum removes the gases and fumes from the mould and this contributes to reducing the risk of explosion. In addition however, the vacuum reduces the pressure of air contained in the voids between the grains and so increases the frictional force between them. In this way the body of the compacted particulate material is held together to resist a tendency to collapse. The level of vacuum applied is preferably of the order of about 130 mm to about 450 mm mercury in the region of the coated pattern.

It is a much preferred feature of the invention that the vacuum be drawn from the bottom of the box. Because the top surface of the compacted unbonded particulate material is exposed to the atmosphere when the vacuum is applied to the body of the material there is a pressure gradient through the height of the compacted particulate material and the system is thus dynamic. The vacuum may be drawn using a medium pressure vacuum pump, preferably a liquid ring pump. The rate of application of vacuum will depend on the permeability of the particulate material and the power of the vacuum pump being used. Using a 50 AFS sand, permeability number 180 to 200, a flow rate of about 15 cubic metres/minute/square metre (about 50 cubic feet/minute/square foot) of box area is preferred.

The vacuum can be established in a matter of seconds before it is wished to pour molten metal into the mould. The vacuum pressure can be measured by means of a probe gauge inserted into the body of the particulate material. The vacuum should be maintained following casting until the casting has started to solidify to the point at which it will not distort or is self supporting. This will depend on the size of the casting: in the case of a small casting the vacuum may be removed two to three minutes following casting and for a large body the period may be five to ten minutes following casting.

The particulate material is preferably a sand. The sand must be sufficiently fine to support the coating on the pattern and sufficiently coarse to allow the removal of the gaseous products of vaporisation or combustion of the expendable pattern. Commercial sands (e.g. Chelford 50 available in Great Britain) are suitable. The sand must offer support to the coating on the expendable pattern but characteristics of the sand will dictate the level of vacuum that can be achieved for a given flow rate of air. This is directly related to the sand permeability which is related to grain fineness and shape. It is preferred that sand grains be rounded since such grains can flow and compact better under vibration.

In evaluations performed using the method of the invention it was observed that a number of patterns in one box may be cast in succession without a fall off in quality.

The invention may be applied to a variety of metals, both ferrous and non-ferrous.

In order that the invention may be well understood it will now be described by way of illustration, with reference to the following examples.

BRIEF DESCRIPTION OF THE DRAWING

The sole FIGURE shows the relationship between the level of vacuum and the depth of sand for different vacuum flow rate.

EXAMPLE I

Figure 1:
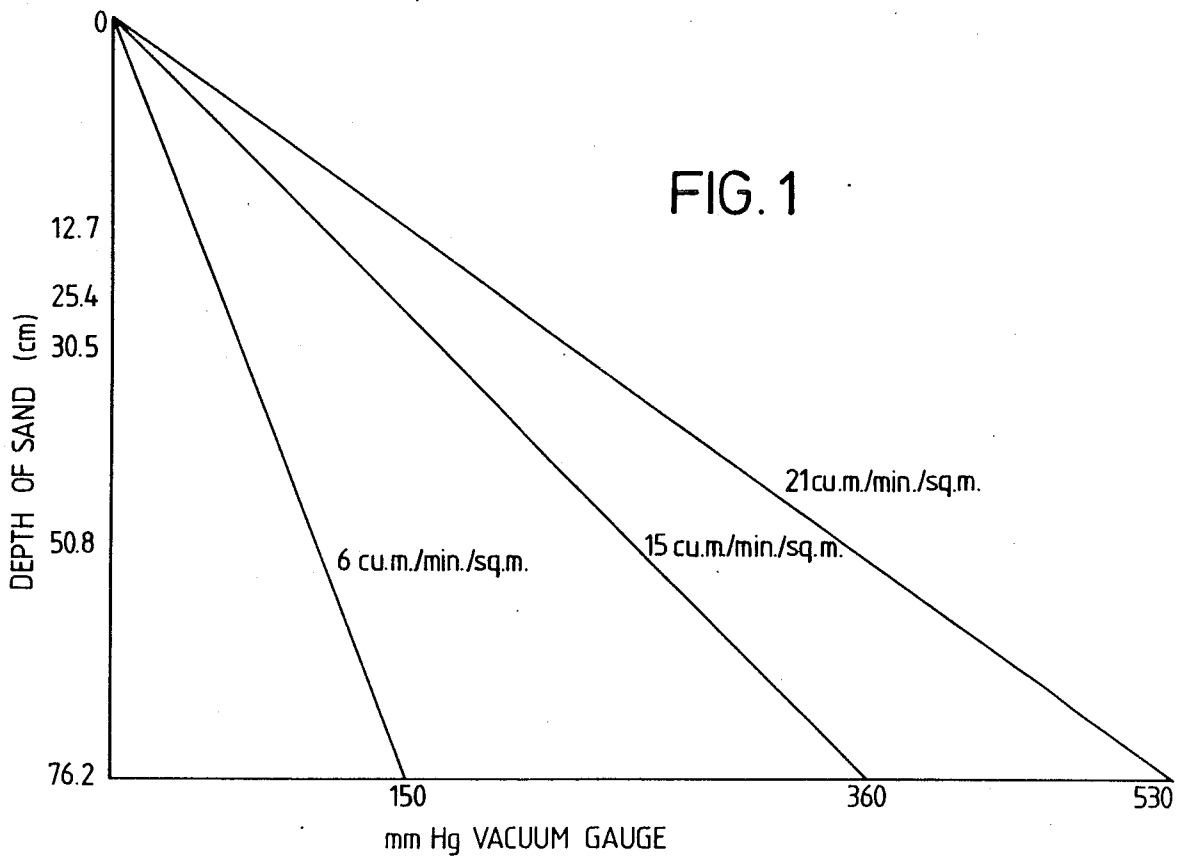

A mould box about 91 cm long and 91 cm wide and having a depth of 76 cm was used in this Example. Below the box were pipes leading to a liquid ring vacuum pump. The unbonded particulate material used was a silica sand, sub-angular, 50 AFS (American Foundryman's Society), permeability of about 180 to 200. Two polystyrene patterns about 24 kg/cu.m. were used in each case, one being shaped to form a simple block and the other being a complex shape to form a valve. Core pieces were not used. The metal cast was steel and in each case the casting weighed about 50 kg. Where a gas-permeable refractory coating was used this was a semithixotropic paint comprising zircon in a non-aqueous carrier having a low binder content.

A. The mould was filled with the sand and the pattern was placed 20 cm below the top surface of the loose sand. The pattern had a paint coating of 0.5 mm. A vacuum was applied to the box at the flow rate of 15 cu.m/minute/sq.m. It was observed that in the case of the complex shape the mould collapsed and the valve formed had a poor surface. In the case of the block the mould also tended to collapse and the casting formed had a poor surface.

This test shows that the use of a vacuum both to compact the loose sand and during casting does not lead to a successful result.

B. The process of test A was repeated but the sand was first subjected to vibration at the rate of 35 Hz, less than 1 g acceleration. The vibration was stopped and a vacuum was applied just before casting to induce a flow rate 15 cu.m/min/sq.m. The results obtained were as in the case of the first evaluation which shows that inadequate vibration does not lead to a successful result.

C. The process of test B was repeated but this time the sand was vibrated at 50 Hz and an acceleration of 1 to 1.5 g for about 60 seconds, until the level of the sand in the box fell by about 10%, to a bulk density of about 1.6 gm/cu.cm and the top surface had a steady appearance. The vacuum was applied just before casting to induce a flow rate of 15 cu.m/min/sq.m. until surface solidification of the casting had taken place. Both the complex shape and the simple block shape formed good quality castings; the mould did not collapse and the working environment was found to be acceptable. At the end of casting the box was inverted and the loose sand was cooled for immediate re-use.

Test C was repeated several times and in each case a totally reliable result was obtained.

D. The process of test C was repeated but this time the vacuum flow rate was reduced to 6 cu.m/min/sq.m. It was observed that the casting tended to break through the top surface of the sand, the mould tended to collapse and there was some evidence of inclusions of gas in the casting formed.

E. The process of test C was repeated but this time a higher vacuum flow rate was used. The use of a higher flow rate increased the risk of metal penetration; this was offset by increasing the thickness of the painted coating, but it was observed that when the flow rate reached 21 cu.m/min/sq.m., the surface of the casting formed was poor. It was therefore decided not to use higher flow rates.

F. In this test the process of test C was repeated except that the head of compacted sand above the pattern was reduced to 5 cm. The casting broke through the top surface of the sand.

G. The process of test C was repeated but using two uncoated patterns. Despite the required head of compacted sand and the required flow rate, the casting formed had a very poor surface and the mould tended to collapse. This shows that a refractory gas-permeable coating is needed.

The results of the tests of this Example show that when the sand is compacted by vibration to the specified bulk density, a gas permeable refractory coating is present on the polystyrene pattern and the sand is subjected to vacuum at the required stage to induce the required pressure gradient, a reliable casting is achieved.

EXAMPLE II

Using the mould box of Example 1 the sand was compacted by vibration at 50 Hz and an acceleration of 1 g. The sand was sub angular silica sand 50 AFS. The level of vacuum and the depth of sand in the box according to flow rate was measured and the results obtained are shown on the accompanying graph of FIG. 1. This graph shows that because the top surface of the compacted surface is uncovered, a pressure gradient is present in the sand. This gradient is a characteristic of the method of invention and is a feature leading to its success.

EXAMPLE III

The process of Example I test C was repeated using a silica sand having a permeability of 100 units and a vacuum flow rate of 7.5 cu.m/min/sq.m; good quality castings were obtained.

EXAMPLE IV

The process of Example I test C was repeated but the mould box contained a pattern shaped to form five interlinking chain links each measuring about 140 mm×180 mm. The casting was done sequantially and each was cast perfectly despite the time interval in casting from the first to the last.

As will be clear from the foregoing description and examples, the success of the invention is due to the controlled pressure gradient in the height of compacted particulate material in the mould box. As indicated herein, the pressure gradient may be created by leaving the top of the box open to the atmosphere and drawing a vacuum from below but the invention includes other ways of creating the controlled pressure gradient for example applying a positive pressure to the top of the particulate material and drawing the vacuum from other locations.

The apparatus used in the method herein comprises a mould box and associated piping for drawing a vacuum, and pumps, and the like. Such apparatus is well known in the art and for this reason those skilled in the art will be able to construct and assemble suitable apparatus without further elaboration.

Without further elaboration the foregoing will so fully illustrate our invention that others may, by applying current or future knowledge, readily adapt the same for use under various conditions of service.

We claim:

1. A method of casting an article of molten metal in a mould box, said box having a top open to the atmosphere, comprising (i) placing loose unbonded particulate material in said box.

(ii) locating within said particulate material an expendable pattern, said pattern being formed of an expanded polystyrene having a density of about 20 kg/cu.m., said pattern having a gas permeable refractory coating thereon, (iii) subjecting said particulate material to vibration at a frequency of at least 40 to 50 Hertz, so that the mould box is subjected to an acceleration of about 1 to 1.5 g, thereby causing said particulate material to be compacted to the maximum bulk density and to be in intimate contact with said refractory coating on said pattern, said vibration being the only means of compacting said particulate material, (iv) applying a vacuum to said compacted particulate material so as to create a pressure gradient in the height of said compacted material, and (v) supplying molten metal into said box so as to vaporize said pattern and form said article of molten metal whereby said molten metal gasifies said expendable pattern, said gases being drawn through said gas permeable coating by said vacuum whereby the pressure of said gases is prevented from disturbing the integrity of said coating and said compacted particulate material remains in intimate contact therewith.

2. A method according to claim 1, in which the top surface of said expendable pattern is disposed below the surface of the material at a depth of about 20 cm.

3. A method according to claim 1, in which said vacuum applied is of the order of 130 mm to 450 mm mercury in the region of said pattern.

4. A method according to claim 1, in which said vibration is performed by mounting said mould box on a vibrating table and applying vibration until the exposed surface of said material has a stable shimmer or rolling appearance.

5. A method according to claim 1, wherein when the molten metal is being cast a vacuum is drawn in said mould box so as to apply a vacuum of the order of from 130 mm to 450 mm mercury in the region of said pattern, whereby gases evolved by the gasification of the pattern caused by the incoming molten metal are drawn through the refractory coating, which remains supported by said vibration compacted particulate material.

* * * * *